US009281567B2

(12) United States Patent
Kim et al.

(10) Patent No.: US 9,281,567 B2
(45) Date of Patent: Mar. 8, 2016

(54) BROADBAND BUILT-IN ANTENNA USING A DOUBLE ELECTROMAGNETIC COUPLING

(75) Inventors: Byoung-Nam Kim, Gyeonggi-do (KR); Jong-Ho Jung, Gyeonggi-do (KR); Seung-Cheol Lee, Incheon-si (KR)

(73) Assignee: ACE TECHNOLOGIES CORPORATION, Incheon-si (KR)

( * ) Notice: Subject to any disclaimer, the term of this patent is extended or adjusted under 35 U.S.C. 154(b) by 255 days.

(21) Appl. No.: 13/501,859

(22) PCT Filed: Oct. 13, 2010

(86) PCT No.: PCT/KR2010/007010

§ 371 (c)(1),
(2), (4) Date: Apr. 13, 2012

(87) PCT Pub. No.: WO2011/046368

PCT Pub. Date: Apr. 21, 2011

(65) Prior Publication Data

US 2012/0200463 A1 Aug. 9, 2012

(30) Foreign Application Priority Data

Oct. 13, 2009 (KR) ..... 10-2009-0097275
Feb. 10, 2010 (KR) ..... 10-2010-0012529

(51) Int. Cl.
*H01Q 1/38* (2006.01)
*H01Q 9/42* (2006.01)

(52) U.S. Cl.
CPC ... *H01Q 9/42* (2013.01); *H01Q 1/38* (2013.01)

(58) Field of Classification Search
USPC ..... 343/700 MS, 702, 818
See application file for complete search history.

(56) References Cited

U.S. PATENT DOCUMENTS 3,736,534 A * 5/1973 Chaffee ..... H01P 9/04 315/3.5
6,028,564 A * 2/2000 Duan ..... G06K 19/07786 340/572.7
7,193,565 B2 * 3/2007 Caimi ..... H01Q 1/243 343/700 MS

* cited by examiner

*Primary Examiner* — Hoang V Nguyen
*Assistant Examiner* — Hai Tran
(74) *Attorney, Agent, or Firm* — TechLaw LLP

(57) ABSTRACT

A broadband internal antenna using double electromagnetic coupling is disclosed. The disclosed antenna may include: a first conducting member electrically connected to a feeding point; a second conducting member placed at a designated distance from at least a portion of the first conducting member so as to allow a first electromagnetic coupling with at least a portion of the first conducting member, and remaining in a floating state without being coupled to a ground and the feeding point; a third conducting member placed at a designated distance from the second conducting member so as to allow a second electromagnetic coupling with the second conducting member, and electrically connected to the ground; and a fourth conducting member extending from the third conducting member, for radiating RF signals. The disclosed antenna has the advantage of providing broadband characteristics within a limited size.

9 Claims, 3 Drawing Sheets

BROADBAND BUILT-IN ANTENNA USING A DOUBLE ELECTROMAGNETIC COUPLING

TECHNICAL FIELD

The present invention relates to an internal antenna, more particularly to a broadband internal antenna using double electromagnetic coupling.

BACKGROUND ART

Together with the recent trends towards smaller and lighter mobile communication terminals, there is also a demand for slimmer structures. Conversely with the continued demand for miniaturization of their size, there is also a demand for diversified functions in the mobile communication terminals.

In this manner, with the miniaturization and diversification of functions in mobile communication terminals, it is needed to minimize the space occupied by the antenna inside a mobile communication terminal, adding to the difficulty in designing the antenna.

In addition, there is a trend toward convergence terminals, wherein a single terminal can handle services for various frequency bands, and accordingly, broadband characteristics and multiband characteristics are becoming the main factors in antennas. For example, there is a demand for an antenna that can support multiband services including short-distance communication service such as Bluetooth, mobile communication services, and wireless LAN services.

Antennas generally used in mobile communication terminals include the helical antenna and the planar inverted F antenna (PIFA).

In the case of a helical antenna, which is designed to protrude outside of the terminal, it is difficult to design an aesthetic appearance and an external appearance suitable for portability; however, an internal structure for this has not been studied, and therefore, it is not appropriate for the current trend that demands an internal antenna.

An inverted F antenna is an antenna designed to have a low-profile structure that makes it possible for installing inside a terminal. Among the beams generated by the current induced in the radiating part in an inverted F antenna, the beams facing the ground are re-induced to attenuate the beams facing the human body, thereby providing improved SAR characteristics, while the beams induced in the direction of the radiating part are strengthened, thereby providing directivity. Moreover, the inverted F antenna operates as a rectangular micro-strip antenna, in which the length of the flat rectangular radiating part can be halved, and thus can implement a low-profile structure.

Such an inverted F antenna offers many advantages as regards miniaturization and radiating characteristics, and is the most widely used internal antenna at present, but has narrowband characteristics, thus presenting difficulty in designing for multiband and broadband characteristics.

In order to overcome these problems of an inverted F antenna, an internal antenna using electromagnetic coupling has been disclosed by the inventor in Korean patent application No. 2008-2266, and FIG. 1 is a drawing illustrating the structure of the internal antenna using electromagnetic coupling disclosed by the inventor.

The internal antenna using electromagnetic coupling according to the structure in FIG. 1 can obtain greater broadband characteristics than an inverted F antenna, but there are instances where the required broadband characteristics cannot be obtained in certain ground structures and terminal structures. Thus, there is a need for a structure that can complement this matter.

DISCLOSURE

Technical Problem

To solve the problems described above, the present invention presents an internal antenna suitable for obtaining broadband and multiband characteristics.

Also, the present invention presents an internal antenna for use in a terminal wherein impedance matching for broadband is efficiently achieved.

Other purposes of the present invention can be derived by those skilled in the art from the embodiments described below.

Technical Solution

An aspect of the present invention presents a broadband internal antenna using double electromagnetic coupling, comprising a first conducting member electrically connected to a feeding point; a second conducting member placed at a designated distance from at least a portion of the first conducting member so as to allow a first electromagnetic coupling with at least a portion of the first conducting member, and remaining in a floating state without being coupled to a ground and the feeding point; a third conducting member placed at a designated distance from the second conducting member so as to allow a second electromagnetic coupling with the second conducting member, and electrically connected to the around; and a third conducting member extending from the third conducting member, for radiating RF signals.

A progressive wave may be generated between the second conducting member and the third conducting member.

The broadband internal antenna may further comprise multiple first protrusions protruding from the second conducting member toward the third conducting member.

The broadband internal antenna may further comprise multiple second protrusions protruding from the third conducting member toward the second conducting member.

The first protrusions and the second protrusions may form a slow wave structure so as to increase coupling.

The first protrusions and the second protrusions may be formed to alternately mesh with each other.

Another aspect of the present invention presents a broadband internal antenna using double electromagnetic coupling, in which feeding is achieved through a first electromagnetic coupling from a first conducting member electrically connected to a feeding point to a second conducting member separated at a designated distance from the first conducting member, and through a second electromagnetic coupling from the second conducting member to a third conducting member separated from the second conducting member at a designated distance and electrically connected to a ground.

Advantageous Effects

An antenna according to the present invention has the advantage of providing broadband characteristics within a limited size.

MODE FOR INVENTION

The broadband internal antenna using double electromagnetic coupling according to certain embodiments of the invention will be described below in more detail with reference to the accompanying drawings.

Figure 1:
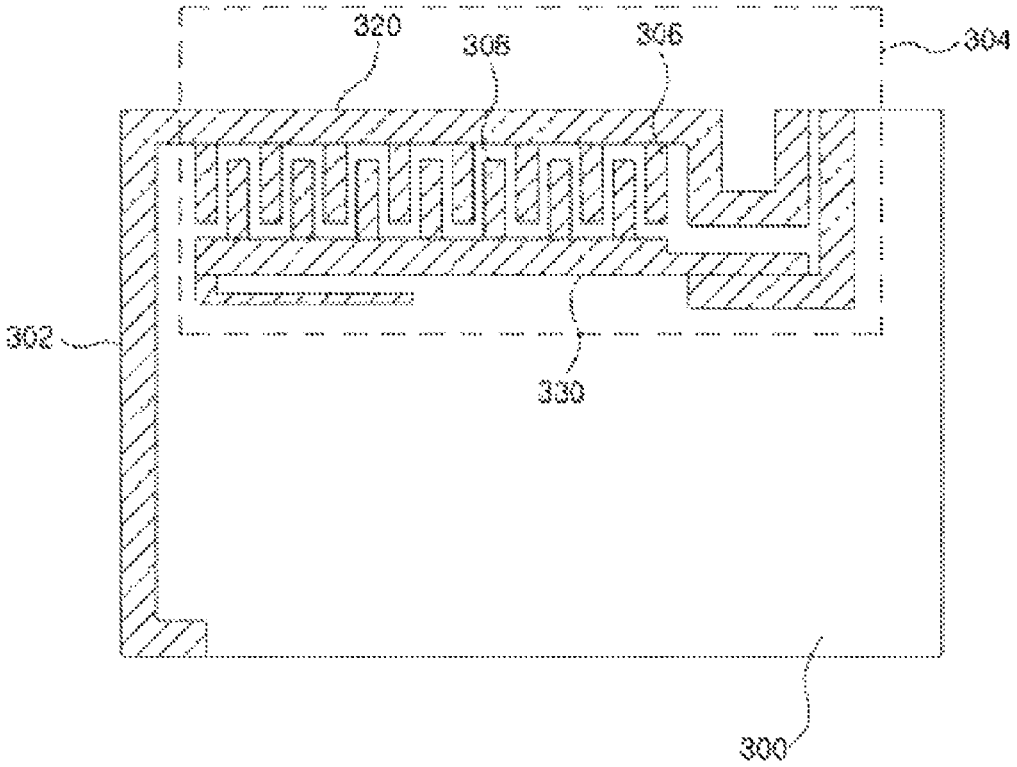
FIG. 1 is a drawing illustrating the structure of an internal antenna using electromagnetic coupling proposed by the inventor.
Figure 2:
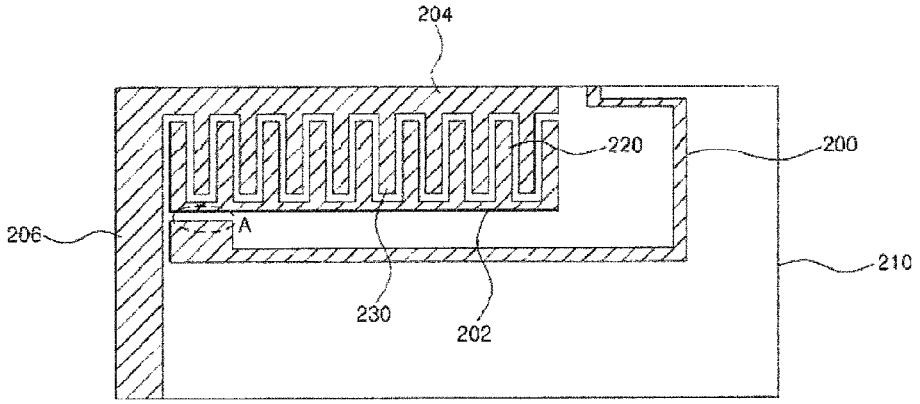
FIG. 2 is a plan view illustrating the structure of an internal antenna using double electromagnetic coupling according to an embodiment of the present invention.

FIG. 2 is a plan view illustrating the structure of an internal antenna using double electromagnetic coupling according to an embodiment of the present invention.

Referring to FIG. 2, an internal antenna using electromagnetic coupling may include a first conducting member 200, a second conducting member 202, a third conducting member 204, a fourth conducting member 206, first protrusions 220 protruding from the second conducting member 202 toward the third conducting member 204, and second protrusions 230 protruding from the third conducting member 204 toward the second conducting member 202. Also, the aforementioned components may be joined to a dielectric structure 210 such as a carrier or a substrate.

The first conducting member 200 is electrically connected to a feeding point, and at least a portion of the first conducting member 200 is placed at a designated distance from the second conducting member 202 so as to allow electromagnetic coupling.

RF signals are inputted to the first conducting member 200 through the feeding point, and a first electromagnetic coupling occurs from the first conducting member 200 toward the second conducting member 202. In FIG. 2, a first electromagnetic coupling may occur in area A where the first conducting member 200 and the second conducting member 202 are close together, and RF signals are inputted through the first electromagnetic coupling to the second conducting member 202.

The second conducting member 202 is separated at a designated distance so as to allow electromagnetic coupling with at least a portion of the first conducting member 200, and is also implemented at a designated distance from the third conducting member 204 so as to allow electromagnetic coupling within a designated area with the third conducting member 204. The second conducting member 202 is implemented in a floating state without being connected to the ground and feeding point.

The third conducting member 204 is electrically connected to the ground and is implemented at a designated distance from the second conducting member 202 so as to allow electromagnetic coupling.

A second electromagnetic coupling occurs between the second conducting member 202 and the third conducting member 204, and RF signals provided from the feeding point are provided to the third conducting member 204. The second electromagnetic coupling to the second conducting member 202 and the third conducting member 204, unlike the first electromagnetic coupling, is achieved in a comparatively wider area, and a progressive wave is generated between the second conducting member 202 and the third conducting member 204.

In other words, in the present invention, feeding is achieved through double electromagnetic coupling by way of the first electromagnetic coupling from the first conducting member 200 to the second conducting member 202 and by way of the second electromagnetic coupling from the second conducting member 202 to the third conducting member 204.

According to the research by the inventor, more broadband characteristics are obtained when the second conducting member 202 and the third conducting member 204 are set to be comparatively long, in order to obtain sufficient coupling between the second conducting member 202 and the third conducting member 204 separated at a designated distance.

However, when the second conducting member 202 and the third conducting member 204 are set to be long, there are difficulties in providing a smaller size for the antenna; therefore, in the present invention, first protrusions 220 and second protrusions 230 that form a slow-wave structure are implemented, in order to obtain sufficient coupling even if the lengths of the second conducting member 202 and the third conducting member 204 are set to be short.

Multiple first protrusions 220 protrude from the second conducting member 202 toward the third conducting member 204, and multiple second protrusions 230 protrude from the third conducting member 204 toward the second conducting member 202.

As illustrated in FIG. 2, it is preferable that multiple first protrusions 220 and second protrusions 230 protrude alternately to mesh with each other. The first protrusions 220 and the second protrusions 230 protruding from the second conducting member 202 and the third conducting member 204 respectively protrude as open stubs, and enables impedance matching for a broad band by substantially increasing the electric lengths of the second conducting member 202 and the third conducting member 204.

FIG. 2 illustrates a case in which the protruding length and width of the first protrusions 220 and the second protrusions 230 are identical, but the length and width of the first protrusions 220 and the second protrusions 230 may be set to be different in parts. Also, FIG. 2 illustrates a case in which the shape of the first protrusions 220 and the second protrusions 230 is rectangular, but the shapes of protruding parts are not thus limited.

The portions of the second conducting member 202 and the third conducting member 204 where electromagnetic coupling is achieved act as an impedance matching part, and the fourth conducting member 206 extending from the third conducting member 204 acts as a radiator.

The radiating frequency of the antenna is determined by the lengths of the third conducting member 204 and the fourth conducting member 206.

As illustrated in FIG. 2, when feeding to the third conducting member is achieved by means of double electromagnetic coupling through the first electromagnetic coupling and the second electromagnetic coupling, there is the advantage of obtaining broader band characteristics within a specific frequency band than when feeding is achieved through single electromagnetic coupling.

Figure 3:
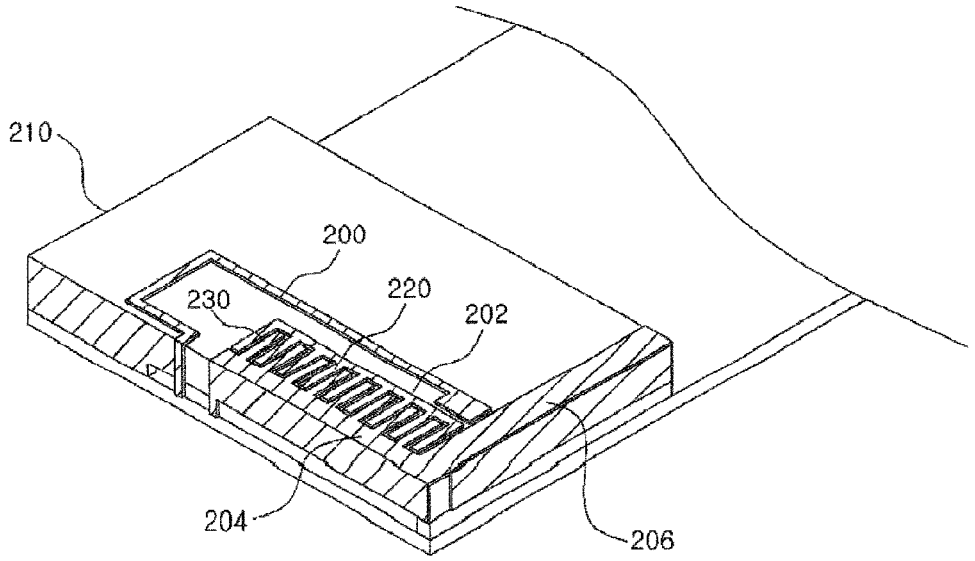
FIG. 3 is a drawing illustrating a perspective view of an internal antenna using double electromagnetic coupling according to an embodiment of the present invention coupled to a dielectric structure.

FIG. 3 is a drawing illustrating a perspective view of an internal antenna using double electromagnetic coupling according to an embodiment of the present invention coupled to a dielectric structure.

Referring to FIG. 3, the first conducting member 200, the second conducting member 202, the third conducting member 204, and the fourth conducting member 206 are joined to the top or side of a dielectric structure 210.

The first conducting member 200 is electrically connected to a feeding point formed on a substrate of a terminal, is formed on the side of the dielectric structure, and extends to the top.

The third conducting member 204 is electrically connected to a ground on a substrate of a terminal, is formed on the side of the dielectric structure, and extends to the top.

FIG. 3 illustrates a case in which the dielectric structure 210 is a right-angle hexahedron, but it should be apparent to those skilled in the art that dielectric structures 210 of various shapes may be used.

Figure 4:
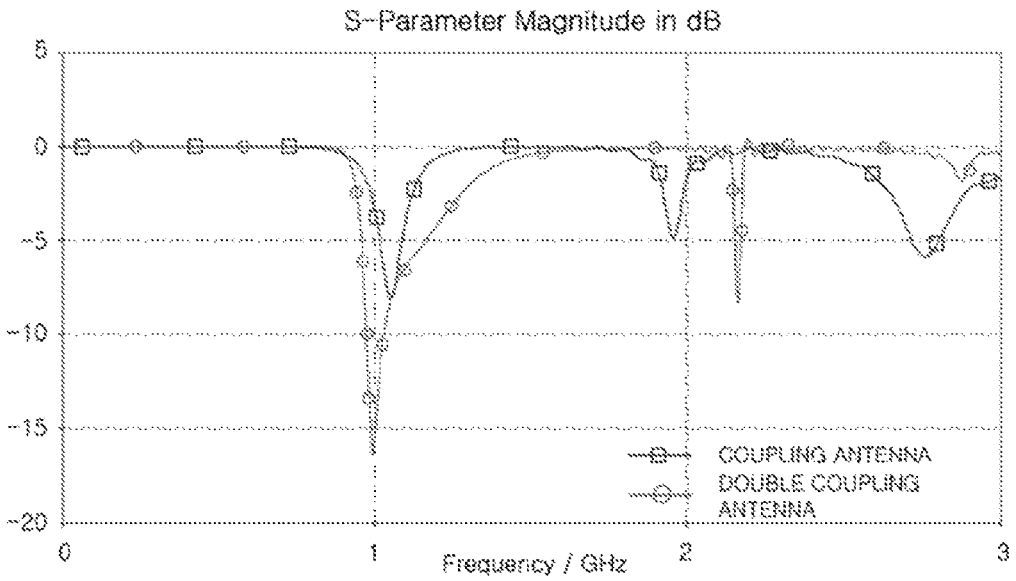
FIG. 4 is a drawing illustrating S11 parameter of an internal antenna using double electromagnetic coupling according to an embodiment of the present invention and S11 parameter of an internal antenna using single electromagnetic coupling.

FIG. 4 is a drawing illustrating the S11 parameter of an internal antenna using double electromagnetic coupling according to an embodiment of the present invention and the S11 parameter of an internal antenna using single electromagnetic coupling.

Referring to FIG. 4, it can be verified that broader band characteristics are shown in low-frequency bands when double electromagnetic coupling is used according to the present invention.

The invention claimed is:

1. A broadband internal antenna using double electromagnetic coupling, comprising:

a first conducting member, electrically connected to a feeding point;

a second conducting member, placed at a designated distance from at least a portion of the first conducting member so as to allow a first electromagnetic coupling with at least a portion of the first conducting member, and remaining in a floating state without being coupled to a ground and the feeding point;

a third conducting member, placed at a designated distance from the second conducting member so as to allow a second electromagnetic coupling with the second conducting member, and electrically connected to the ground;

a fourth conducting member, extending from the third conducting member, for radiating RF signals, and a plurality of first protrusions protruding from the second conducting member toward the third conducting member;

wherein the first conducting member and the third conducting member are not electrically connected and the third conducting member is not electrically connected to the feeding point.

2. The broadband internal antenna using double electromagnetic coupling according to claim 1, wherein a progressive wave is generated between the second conducting member and the third conducting member.

3. The broadband internal antenna using double electromagnetic coupling according to claim 1, further comprising a plurality of second protrusions protruding from the third conducting member toward the second conducting member.

4. The broadband internal antenna using double electromagnetic coupling according to claim 3, wherein the first protrusions and the second protrusions form a slow wave structure so as to increase coupling.

5. The broadband internal antenna using double electromagnetic coupling according to claim 3, wherein the first protrusions and the second protrusions are formed so as to alternately mesh with each other.

6. The broadband internal antenna using double electromagnetic coupling according to claim 3, wherein the length and width of the first protrusions and the second protrusions are set to be different in parts.

7. The broadband internal antenna using double electromagnetic coupling according to claim 1, wherein the first protrusions and the third conducting member form a slow wave structure so as to increase coupling.

8. The broadband internal antenna using double electromagnetic coupling according to claim 1, wherein the first protrusions and the third conducting member are formed so as to alternately mesh with each other.

9. The broadband internal antenna using double electromagnetic coupling according to claim 1, wherein the length and width of the first protrusions and the third conducting member are set to be different in parts.

* * * * *